US006390153B1

(12) United States Patent
Flider et al.

(10) Patent No.: US 6,390,153 B1
(45) Date of Patent: May 21, 2002

(54) VALVE BODY FOR SAFETY CANS

(75) Inventors: Frank S Flider; Ted E Holmes, both of Mattoon, IL (US)

(73) Assignee: Justrite Manufacturing Company LLC, Mattoon, IL (US)

( * ) Notice: Subject to any disclaimer, the term of this patent is extended or adjusted under 35 U.S.C. 154(b) by 0 days.

(21) Appl. No.: 09/862,071

(22) Filed: May 21, 2001

(51) Int. Cl.[7] ..... B65B 1/04

(52) U.S. Cl. ..... 141/302; 141/98; 222/469; 222/566

(58) Field of Search ..... 222/469–475, 222/566; 141/386, 98, 285, 301, 302, 304, 305, 309; 220/318; 215/396

(56) References Cited

U.S. PATENT DOCUMENTS

| | | | | |
|---|---|---|---|---|
| 2,335,195 A | * | 11/1943 | Packer | 222/469 |
| 3,727,807 A | | 4/1973 | Flider | |
| 3,729,122 A | * | 4/1973 | Flider | 215/396 |
| 3,729,129 A | | 4/1973 | Flider | |
| 3,927,797 A | * | 12/1975 | Flider | 220/318 |
| 4,491,251 A | | 1/1985 | Pratz et al. | |
| 4,645,099 A | | 2/1987 | Gillispie et al. | |

* cited by examiner

*Primary Examiner*—Steven O. Douglas

(57) ABSTRACT

The invention relates to a safety container for inflammable liquids, including a single valve body that has a pour-spout and a fill-spout, as well as a concerted venting means which are all located within the single valve body, thus eliminating user confusion and increasing safety by having one valve body containing all of these said functions.

10 Claims, 5 Drawing Sheets

VALVE BODY FOR SAFETY CANS

BACKGROUND OF THE INVENTION

This invention relates to safety cans or containers for holding fluids and especially, although not exclusively, to containers for inflammable fluids such as gasoline and the like. As per the prior art, these safety containers may be one of two types. The first type is commonly referred to as a Type I can. The Type I can is a container with one spout through which both filling and pouring are achieved. It is economically designed and is most often used for liquids to be poured into containers having wider openings than the opening of the Type I can, unless an additional hose attachment is used in order to prevent spillage. The Type I can is thus only efficient when pouring into wider openings because it is inefficient to continually attach an additional hose attachment when pouring, remove this attachment when filling, and then reattaching the additional hose attachment for pouring again.

The second type is commonly referred to as a Type II can. The Type II can is a container with two separate spout openings, one used for filling purposes, and one used for pouring purposes. Commonly there is a hose associated with the pouring spout to allow pouring into a small opening. Also, Type II cans require venting. Type II cans allow easier pouring than Type I cans, because the Type II can commonly has an attached hose that does not need detaching every time the container must be filled. However, these cans are often economically more expensive in production due to the need of producing two spouts, and further, these duel spouts can become unrulely in use and often lead to confusion.

There have been several improvements to the Type I and Type II containers. Pratz, et al. in U.S. Pat. No. 4,491,251 disclosed a Type I can with a means, being a pair of handles, for opening and closing said spout. Flider, in U.S. Pat. Nos. 3,727,807 and 3,729,129 disclosed a Type II container with a carrying handle that also serves as an actuating means for opening each spout. Gillispie, et al. in U.S. Pat. No. 4,645,099, disclosed a safety container having a rigid handle and means extending below said handle for opening the pouring spout and simultaneously lifting the spring-biased safety cap.

The current invention is a valve body and safety can that is the novel combination of the Type I and Type II cans which allows for economical design and less confusing use of a Type I can and moreover allows the more efficient filling and pouring design of a Type II can and further provides a concerted venting means, all in the same valve body.

DETAILED DESCRIPTION OF THE DRAWINGS

Figure 1:
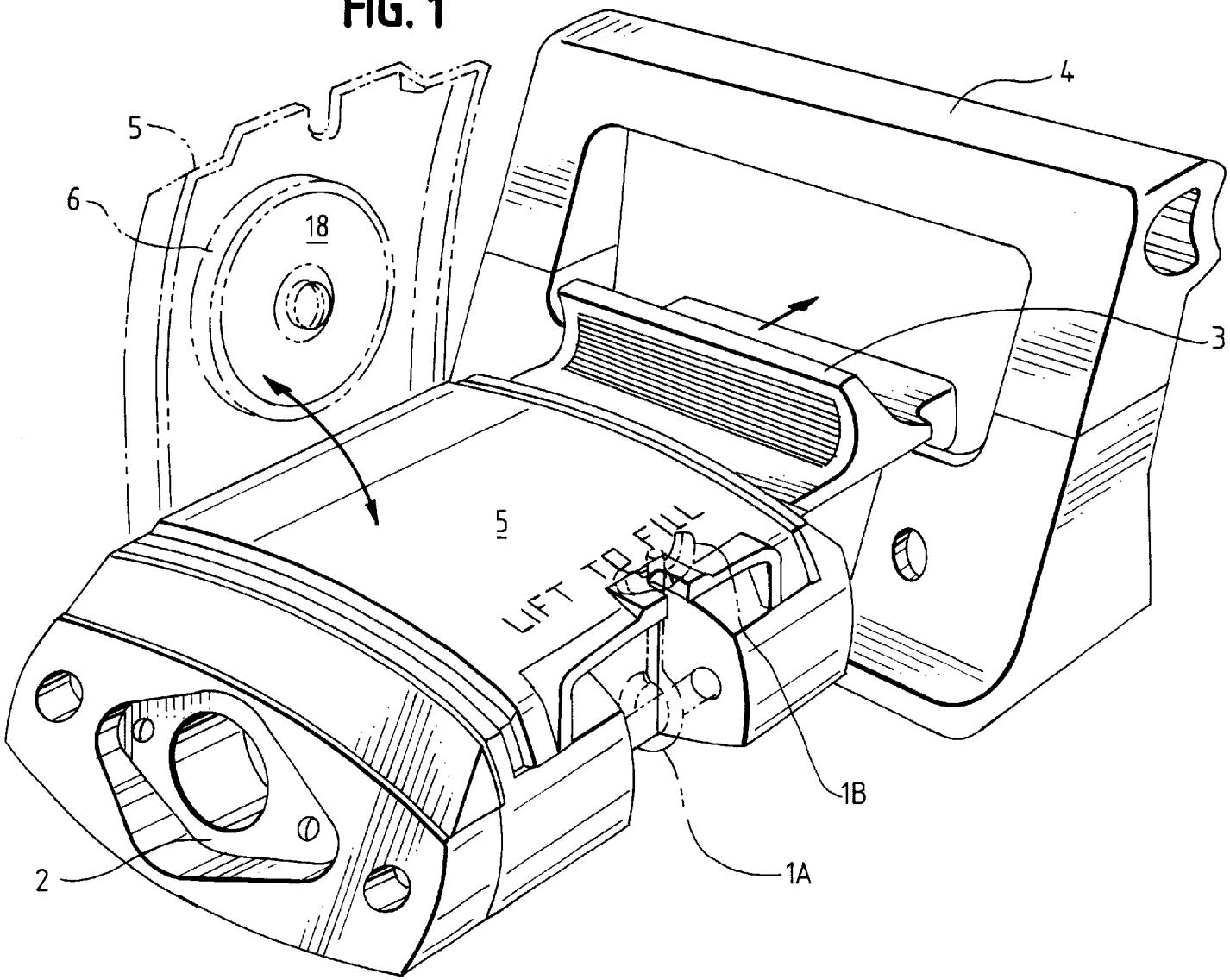
FIG. 1 is a perspective view of the novel valve body for liquids claimed herein.

Referring to the Drawings, FIGS. 1 through 5, and more particularly to FIG. 1, the novel valve body, 26, is shown and the pour-spout, 2, is shown. The fill-spout is hidden beneath the valve body cover lid, 5, in the closed position. The fill-spout, the pour-spout, along with a concerted venting mechanism, are all in combination in this one valve body.

Figure 2:
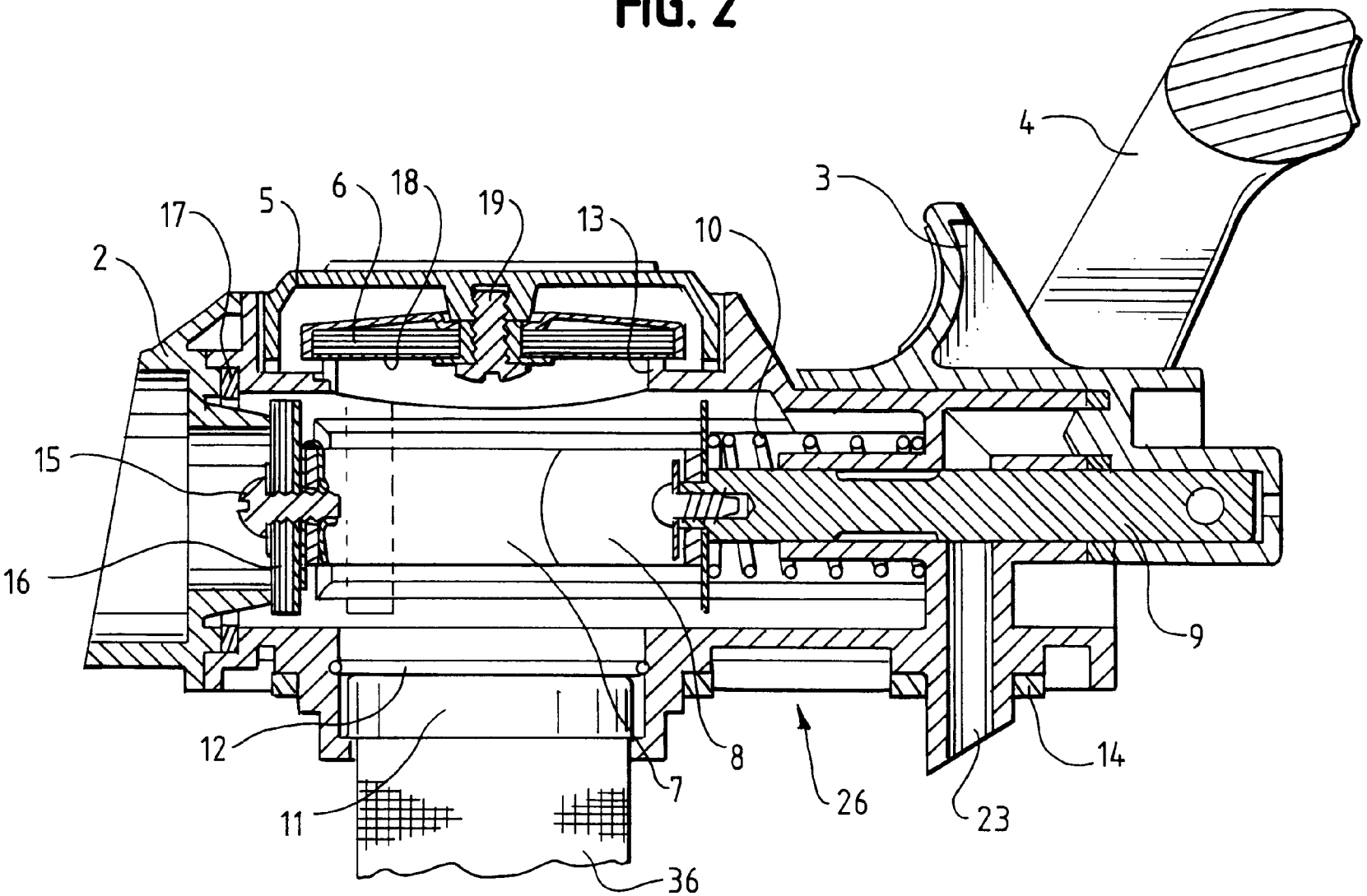
FIG. 2 is a cross-sectional view showing the vertical plane through the center of the valve body.
Figure 3:
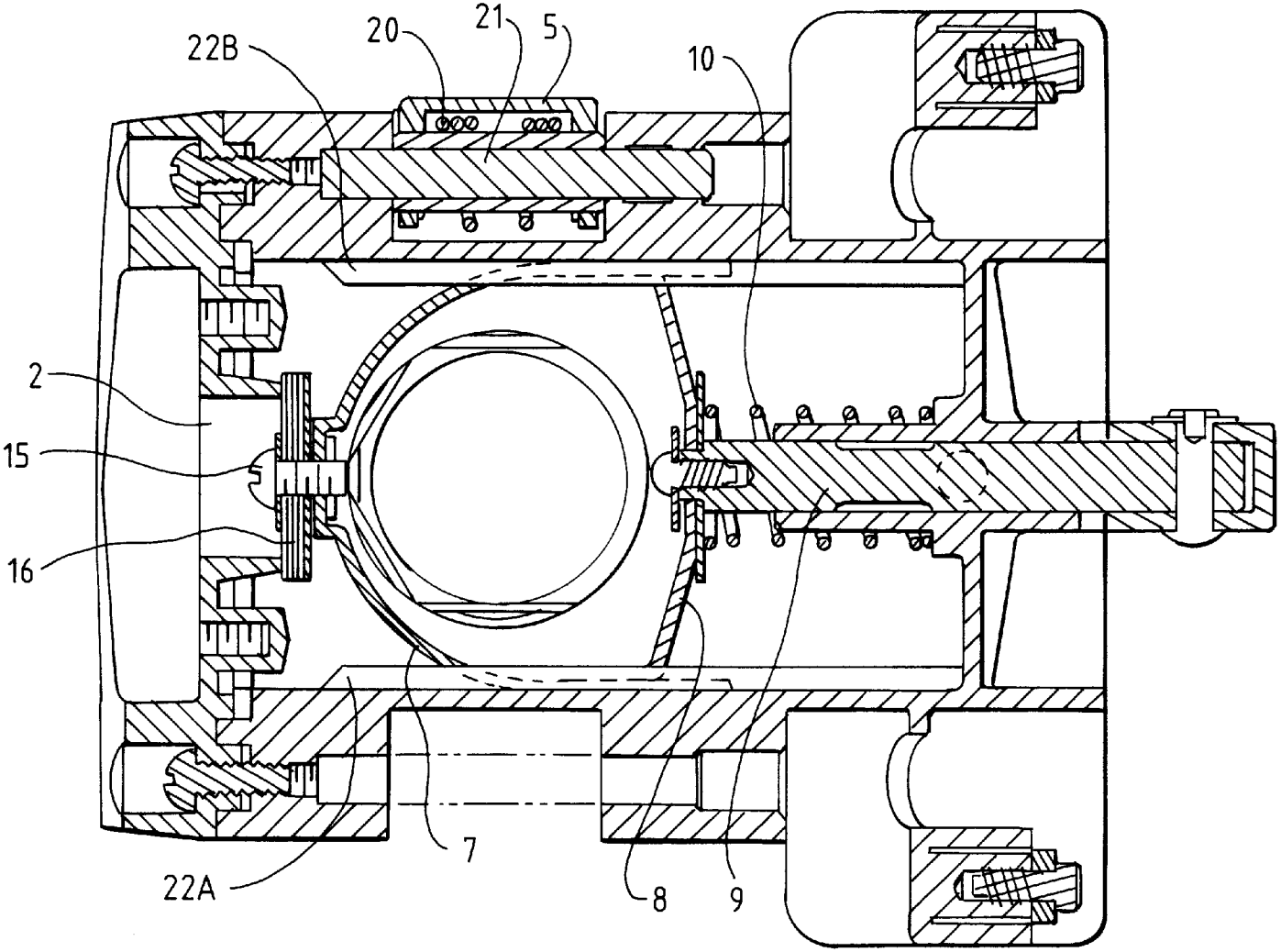
FIG. 3. is an elevational view of the top of the novel valve body.

In FIG. 1, the valve body cover lid, 5, is secured and sealed closed by a securing means preferably shown as a combination eye-bolt, 1A, and wing-nut, 1B. Also, the valve body cover lid, 5, is preferably spring biased whereby a valve body cover spring, 20 in FIG. 3, in its rested position, holds the valve body cover lid, 5, in the closed position at the valve body cover lid hinge, 21, for safety purposes and to prevent spillage. While the valve body cover lid, 5, is in the closed position, the fill-spout cover, 6, and the fill-spout gasket, 18, form a physical seal with the valve body, 26, as shown in FIG. 2. The valve body cover spring, 20 in FIG. 3, is biased in a manner to hold closed the valve body cover lid, 5, however, if a pressure inside the cavity of the safety container builds and exceeds 5 p.s.i., the valve body cover lid spring, 20, is effectuated and the valve body cover lid, 5, is opened thereby acting as a pressure release means when the lid is not sealed tight with the securing eye-bolt/wing nut means, 1A/1B.

Figure 5:
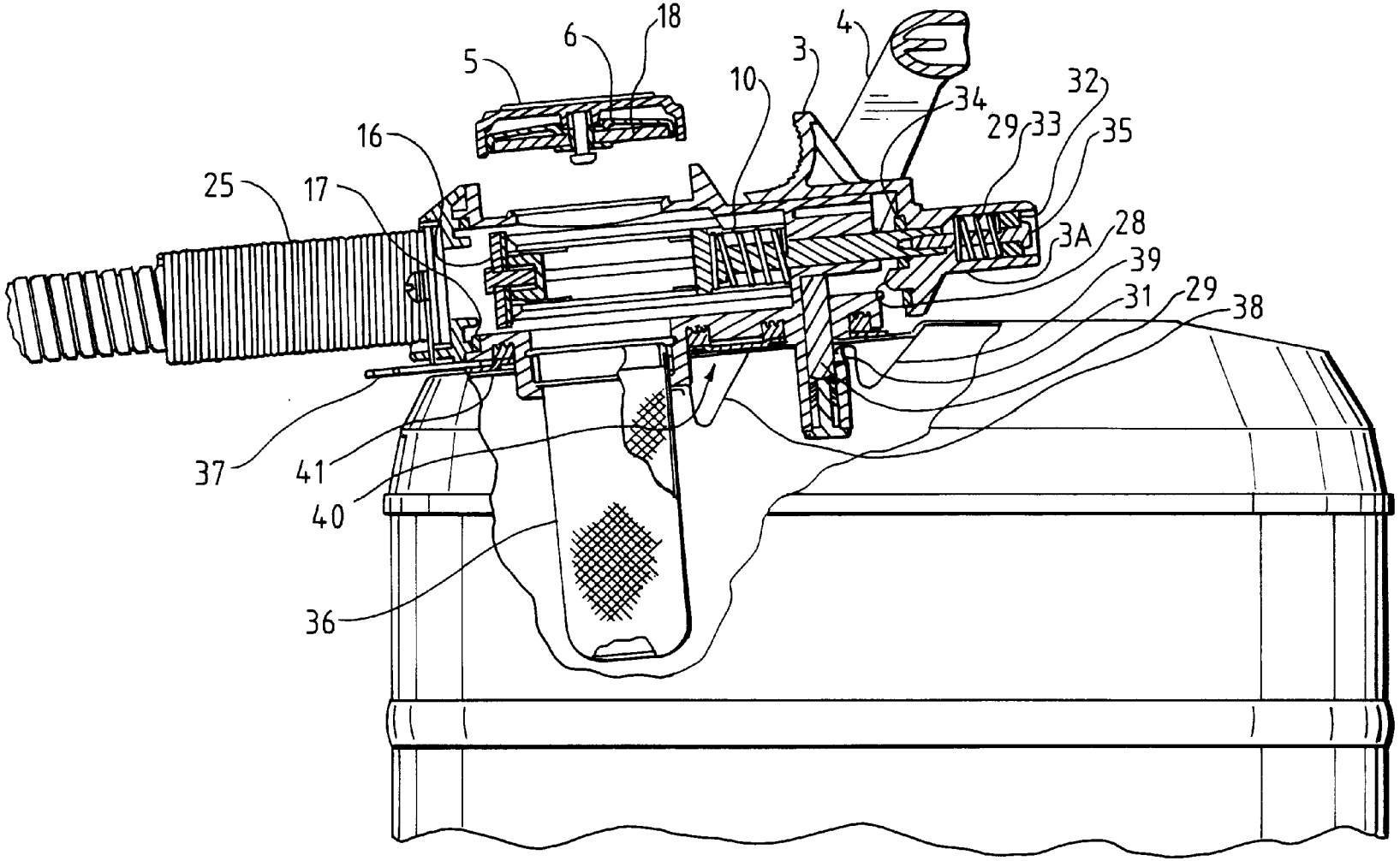
FIG. 5 is a half-sectional view showing a second embodiment of a valve body that also embodies this invention.

The pour-spout, 2, is the means by which the liquid is expelled from the container. Though the valve body, 26, is functional as shown in FIG. 1, preferably a hose attachment, not shown in FIG. 1, is removably attached to the pour-spout, 2, as shown in FIG. 5, as a second embodiment. This hose attachment, 25, will allow more efficient pouring into smaller openings.

Pouring through the pour spout, 2, is gained by exerting an upward force upon the valve body handle, 4, and simultaneously lifting the bottom end of the container opposite the pour-spout, 4, thus forcing the liquid in the container towards the pour-spout, 2. A valve body, 26 in FIG. 2, also allows for concerted venting while pouring by means of actuating the pour-trigger, 3.

FIG. 2 is a sectional view taken on a vertical plane passing through the center of valve body, 26. In FIG. 2 valve body cover lid, 5, is shown in the closed position. Fill-spout gasket, 18, is associated with the fill-spout cover, 6, and both are associated with valve body cover lid, 5, by means of fill spout screw, 19. Fill-spout cover, 6, and fill-spout gasket, 18, form a seal with fill-spout ring, 13, when valve body cover lid, 5, is closed and sealed.

Valve body cover lid, 5, is opened by loosening wing-nut, 1B in FIG. 1, to allow eye-bolt, 1A in FIG. 1, to be removable from the eye-bolt slot in the coverlid, 5, so as to allow valve body cover lid, 5, to rotate on valve body cover lid hinge, 21 in FIG. 3. When valve body cover lid, 5, is in the open position, the atmosphere inside the container is open to the outside atmosphere through fill-spout ring, 13, alone. This allows for efficient and clean filling of the container through fill-spout ring, 13, because pour-spout, 2, is sealed closed by center shaft assembly, 27 in FIG. 4.

Figure 4:
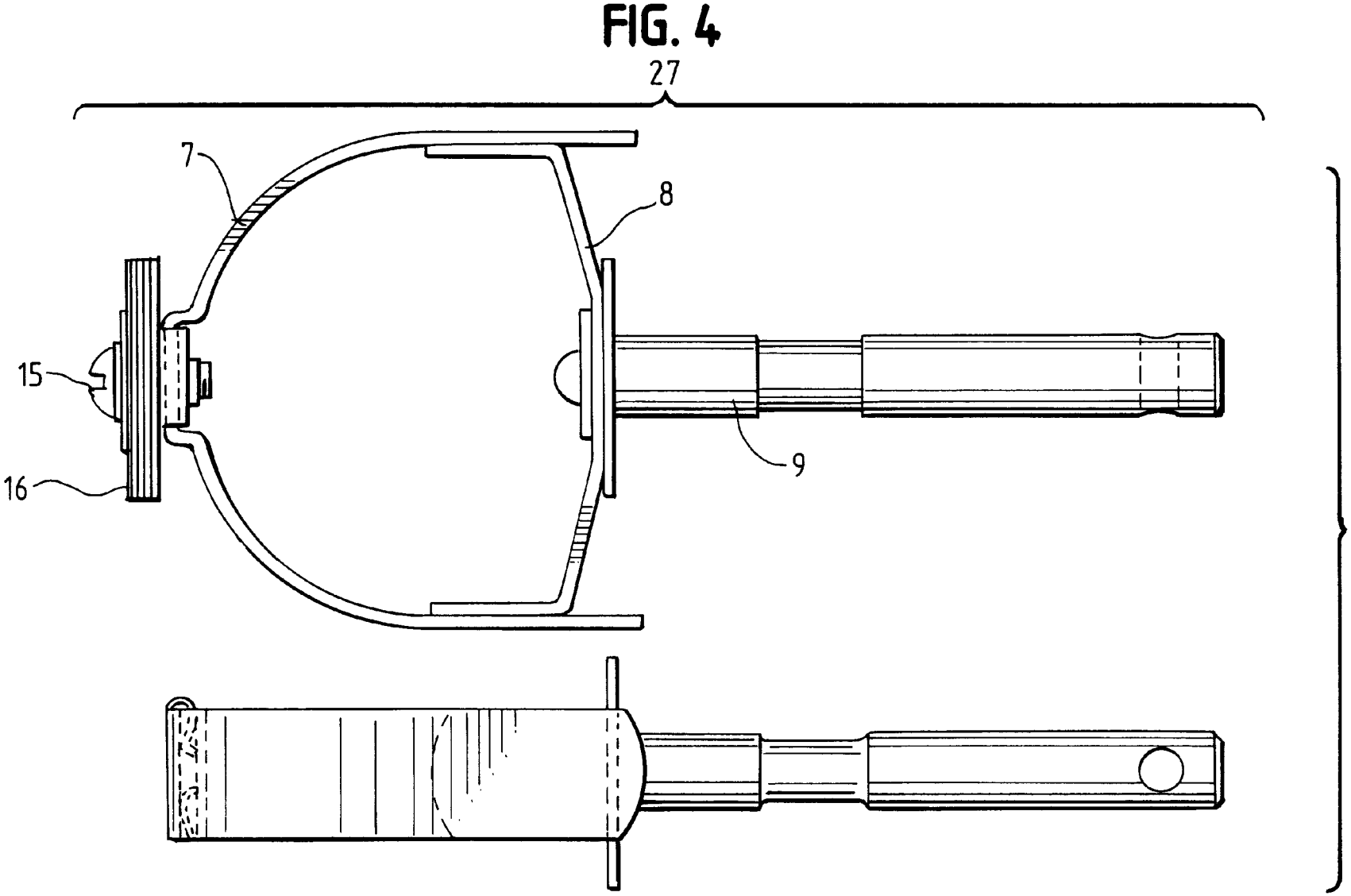
FIG. 4. is a view of the center shaft unit.

Center shaft assembly, 27, in FIG. 4, comprises center shaft, 9, fixedly attached to center shaft seal bracket, 8, fixedly attached to seal plug bracket, 7, fixedly attached to front seal gasket, 16, by front seal gasket screw, 15. Center shaft assembly, 27, serves two functions. First, center shaft assembly, 27, is held in the closed position by center shaft guides, 22A and 22B in FIG. 3, that are fixedly attached along the walls of valve body, 26. In a rested state, center shaft spring, 10, effects the center shaft assembly which seals closed pour-spout, 2, by perfecting a seal with pour spout gasket, 17. Pour trigger, 3, is associated with center shaft, 9, thereby causing movement of center shaft assembly, 26, in the same direction as the force exerted on pour trigger, 3. When a force is exerted on pour trigger, 3, in a direction opposite that of pour-spout, 2, center shaft assembly, 27, is simultaneously moved in the direction opposite pour-spout, 2, thereby opening pour spout, 2, and allowing the liquid in the atmosphere of the container to be poured through pour spout, 2, into the outside atmosphere.

The second function of center shaft assembly, 27, is to simultaneously provide a means for venting while pouring. In one embodiment, center shaft, 9, is a rod having two separate distinct girths as shown in FIGS. 2–4. When the valve body system is at rest, center shaft spring, 10, is exerting a force on the center shaft assembly, 27, thereby sealing pour-spout, 2, and center shaft, 9, is in a position whereby the wider girth sections of center shaft, 9, form a seal between venting chamber, 23, and the inner cavity of the valve body. When pour trigger, 3, is actuated, center shaft assembly, 27, is simultaneously engaged and the narrower girth section of center shaft, 9, is positioned over venting chamber, 23, and venting gasket, 14. This enables the container's atmosphere to naturally flow through the venting chamber, 23, through the space around the narrower section of center shaft, 9, into the valve body chamber, across the liquid interface of the liquid in the container and out through pour-spout, 2. This Bernouli effect promotes the flow of liquid through pour spout, 2, and thus vents the liquid being poured.

The alternative embodiment of this simultaneous pouring/venting feature is shown in FIG. 5. Here, the trigger, 3, extends beneath and below the handle, 4, and physically forms the rear exterior of the valve body assembly, the rear trigger portion, 3*a*. Trigger, 3, extends and includes a rear trigger portion, 3*a*, from which male protrusion, 28, extends inward towards valve body assembly, 40. When the valve body assembly, 40, is in a rested state, male protrusion, 28, on the rear trigger portion, 3*a*, is coupled with female receptacle, 29, in the valve body assembly, 40, perfecting a seal with vent-seal gasket, 34. The trigger, 3, is also physically associated with the center shaft assembly, 27, by spacer, 32, trigger spring, 33, as well as machine screw, 35.

When trigger, 3, is actuated, male protrusion, 28, is uncoupled with female receptacle, 29, while simultaneously center shaft assembly, 27 is uncoupled with pour-spout, 2. Venting occurs by atmosphere entering the valve body through female receptacle, 29, passing through vent arrestor, 30, and into the container through a secondary opening, 31, in the valve body and then across the liquid/air interface within the container and then out of the container through the pour spout, 2.

A further novelty of this alternate embodiment shown in FIG. 5 is an independent spring system that individually seals the female receptacle, 29, and the pour-spout, 2. Independent seating is required to allow proper sealing between locations, which may be affected by cumulative manufacturing tolerances and to accommodate alignment. This is accomplished through the use of center shaft spring, 10, and trigger spring, 33. While the valve body is in a rested state, the center shaft spring, 10, exerts a force on the center shaft assembly, 26, thereby perfecting a seal of the front seal gasket, 16, with the pour spout, 2. Also, as front seal gasket, 16, seals with the pour spout, 2, vent seal gasket, 34, seals with female receptacle, 29, and the rear of the valve body.

However, due to cumulative manufacturing tolerances and misalignment, trigger spring, 33, in combination with machine screw, 35, and spacer, 32, allows adjustment and individual sealing of trigger, 3, and male protrusion, 28, with the rear of the valve body and the female receptacle, 29. A user adjusting the machine screw, 35, will effectuate trigger spring, 33, and allow for independent sealing of the female receptacle, 29, and thus perfect a seal and prevent venting.

FIG. 4 shows the construction of the center shaft assembly, 26. The center shaft, 9, is shown as having two separate girths for the purpose of the venting means. The center shaft seal bracket, 8, is fixedly attached to the center shaft, 9, and serves as the contact points for the attachment of the seal plug bracket, 7, which is fixedly attached at both ends of the center shaft seal bracket, 8. The front seal gasket, 16, is fixedly attached to the seal plug bracket, 7, by the front seal gasket screw, 15.

FIG. 5 also illustrates an electrical grounding system for the safety can. FIG. 5 illustrates electrical grounding or bonding of the hose attachment, 25, to the main can body as well as the bonding of the main arrester, 36, and the vent arrester, 30 to the mounting plate, 41. The mounting plate, 41, is a flat electrically conductive plate that is fixed between the valve body assembly, 40, and the safety container. The hose attachment, 25, the vent arrester, 30, and the main arrester, 36, are all bonded to the mounting plate, 41, via the ground straps, 37, 38, 39. This boding is critical to a valve body using a polymer-based material, which may not be electrically conductive.

From the foregoing detailed description of the invention, it has been shown how the objects of the present invention have been obtained in a preferred manner. However, modifications and equivalents of the disclosed concepts such as readily occur to those skilled in the art are intended to be included within the scope of the invention.

What is claimed is:

1. A safety container for holding inflammable fluids having two openings on the top thereof, one opening for filling and pouring and the other for venting said container, comprising in combination:

a. a valve body, covering and controlling both of said safety container openings, said valve body having;
   i. a fill-spout,
   ii. a valve body cover lid hingedly attached to said valve body to removeably cover said fill spout,
   iii. a pour-spout,
   iv. a center shaft assembly that is slideably mounted in said valve body,
   v. a vent-hole,
   vi. a spring means operatively biasing said center shaft assembly in both a sealing contact with said pour-spout and a sealing contact with said vent hole,
   vii. a pour trigger operatively associated with said center shaft assembly, said pour trigger being actuated to slideably move said center shaft assembly; and b. a handle portion operatively associated with said valve body and said container.

2. A safety container defined in claim 1, wherein said center shaft assembly has a sealing means on one end thereof that forms a seal with said pour-spout when forced into contact with said pour-spout by said spring means to seal same when said center shaft assembly is in its closed position, said center shaft assembly on its opposite end having a center shaft having a wider girth portion and a narrower girth portion and a biasing means that is biased to exert a force on the center shaft assembly to create a seal with said pour-spout, and while said center shaft assembly is in its closed position said wider girth portion of said center shaft simultaneously is in line with said venting hole sealing off vent flow of said container.

3. A safety container as defined in claim 1, further comprising concerted venting and pouring means, comprising said center shaft assembly having two actionable ends, one end sealing and opening said pour spout, and the opposite end sealing and opening said vent hole, whereby concerted movement of said ends is actuated by said pour trigger.

4. A safety container as defined in claim 1, further comprising a rear trigger portion of said pour trigger that covers the back side of said valve body assembly, said rear trigger portion having a means to seal said vent hole when said valve body is in a rested state.

5. A safety container as defined in claim 1, further comprising a handle portion operatively associated with said trigger means by being proximate to said trigger means to enable grasping of said trigger means in a concerted motion with lifting said safety can with said handle and actuating said trigger means and tilting said can for pouring.

6. A safety container as defined in claim 1, further comprising said valve body having a handle portion as an integral and physical part thereof and being proximate to said trigger means to enable grasping of said trigger means in a concerted motion with lifting said safety can with said attached handle and actuating said trigger means and tilting said can for pouring.

7. A safety container as defined in claim 1, further comprising said valve body having an independent sealing means comprising:

a. a first spring means associated with said valve body and biasing said center shaft assembly in both a sealing contact with said pour-spout and a sealing contact with said vent hole, b. a spacer;

c. a securing means;

d. said spacer adjustably fastened to said pour trigger by said securing means;

e. a second spring means associate with said pour trigger and a spacer associated with said securing means biasing said rear trigger portion in sealing contact with said valve body and said vent hole;

f. said second spring means being adjustable independently from said first spring means.

8. A safety container as defined in claim 1, further comprising a hose attachment removeably attached to said valve body and in alignment with said pour-spout so that liquid inside said safety container may be poured through said pour spout and through said hose attachment to achieve more accurate and efficient pouring.

9. A safety container as defined in claim 1, further comprising an electrical grounding means comprising:

a. an electrically conductive mounting plate;

b. a hose attachment removeably associated with said valve body in alignment with said pour spout.

c. a hose ground physically associated with said hose attachment and said mounting plate;

d. a main arrester ground physically associated with said valve body and said mounting plate;

e. a vent arrester located in said vent hole; and f. a vent arrester ground physically associated with said vent arrester and said mounting plate.

10. A safety container for holding inflammable fluids comprising in combination:

a. a valve body have both a fill spout and a pour spout;

b. a valve body cover lid hingedly attached to said valve body and removeably covering said fill spout;

c. a venting means in said valve body;

d. a center shaft assembly that is slideably mounted in said valve body to simultaneously effectuating pouring and venting of said safety container.

* * * * *